US006779535B2

(12) United States Patent
Drukarov

(10) Patent No.: US 6,779,535 B2
(45) Date of Patent: Aug. 24, 2004

(54) PAINT BRUSH CLEANING DEVICE

(76) Inventor: Henry Drukarov, 6 Hazelwood Ave., Livingston, NJ (US) 07039

( * ) Notice: Subject to any disclaimer, the term of this patent is extended or adjusted under 35 U.S.C. 154(b) by 9 days.

(21) Appl. No.: 10/347,477

(22) Filed: Jan. 21, 2003

(65) Prior Publication Data

US 2004/0139994 A1 Jul. 22, 2004

(51) Int. Cl.[7] ..... B03B 3/12

(52) U.S. Cl. ..... 134/198; 134/201; 239/592; 239/594; 239/583; 239/541; 239/453; 239/454; 239/456; 239/459

(58) Field of Search ..... 134/198, 201; 239/592, 594, 583, 541, 453, 454, 456, 459; 252/415; 251/339

(56) References Cited

U.S. PATENT DOCUMENTS

| | | | | |
|---|---|---|---|---|
| 1,864,133 A | * | 6/1932 | Hammer | 222/181.2 |
| 2,227,706 A | * | 1/1941 | Conner | 222/322 |
| 2,985,178 A | | 5/1961 | Christensen | |
| 3,804,337 A | * | 4/1974 | Schmidhuber et al. | 239/513 |
| 4,018,240 A | | 4/1977 | Palthe | |
| 4,230,243 A | * | 10/1980 | Spitzer et al. | 222/402.18 |
| 4,403,364 A | | 9/1983 | Schroeder | |
| 4,641,673 A | | 2/1987 | Conley | |
| 4,823,424 A | | 4/1989 | Allen | |
| 4,865,188 A | | 9/1989 | Custeau | |
| 4,912,797 A | | 4/1990 | Brackett | |
| 6,036,117 A | * | 3/2000 | Heren et al. | 239/456 |
| 6,196,477 B1 | * | 3/2001 | Halltorp et al. | 239/579 |

FOREIGN PATENT DOCUMENTS

| | | | |
|---|---|---|---|
| EP | 0 437 112 A2 * | 7/1991 | B05B/1/32 |

* cited by examiner

*Primary Examiner*—Randy Gulakowski
*Assistant Examiner*—Gentle E. Winter
(74) *Attorney, Agent, or Firm*—Boris Leschinsky

(57) ABSTRACT

A cleaning device for a paint brush comprises a hollow nozzle attached to a source of pressurized cleaning solution such as water, solvent, liquefied hot soap or alike. The distal tip of the nozzle is equipped with a poppet valve such that the body of the valve protrudes from the distal tip. The proximal section of the nozzle is adapted to be attached to a source of cleaning solution, that in the most basic configuration being a common tap water valve. When the water valve is opened, the brush is moved towards the nozzle. Upon engaging with the heel or bristles of the brush, the poppet valve moves inwards and opens the flow of water towards the center of the brush allowing washing out any remaining wet and dissolved paint. In another embodiment of the invention, the cleaning device includes a hollow handle attached to a source of pressurized cleaning solution and equipped with one or more nozzles each having a poppet valve. The shape of the nozzle is tapered towards the distal tip to further facilitate separation of the bristles of the paint brush.

16 Claims, 2 Drawing Sheets

PAINT BRUSH CLEANING DEVICE

BACKGROUND OF THE INVENTION

This invention relates to an apparatus useful in cleaning wet paint from paint brushes. More particularly, this invention relates to apparatus used in water cleansing of paint brush heels utilizing water based paints. It should be noted here that other types of paint (such as oil-based paint for example) or varnishes could be cleaned away with the use of the device of the present invention. Besides, the device of the invention can also be used advantageously to clean other types of paint-applying devices such as paint rollers.

For the purposed of this disclosure, the term "cleaning solution" means water, solvent, alcohol, acetone, liquefied soap or any other appropriate cleaning agent depending on the nature of the paint or varnish to be removed from the brush.

Paint brushes are exceedingly useful and efficient tools for applying paint to various surface areas. Unfortunately, it is rather difficult to clean the paint from the brush after it has been used. The most difficult area to clean is at the heel of the brush where the bristles are compressed together.

At present there are a number of ways to clean paint soaked brushes, although neither is particularly efficient. One method is to place the paint brush in water and repeatedly squeeze the brush by hand to mechanically remove most of the paint from the bristles. A final rinse under running water is performed in an effort to remove the remaining paint residue. Soaking is a solvent solution of water can first be optionally applied. A useful container for such soaking is disclosed in the U.S. Pat. No. 4,865,188.

More sophisticated methods and devices for paint removal have been proposed in the prior art as follows. The U.S. Pat. No. 1,542,025 discloses a hand operated paint brush cleaner employing a pair of opposed bristle brushes in a pool of cleaning solution. The cleaning brushes do not engage the paint brush heel; that is, where the bristles meet the handle and where much unwanted paint tends to accumulate. The U.S. Pat. No. 2,737,945 disclose a device designed to dry hardened paint to powder through the use of heating elements, while U.S. Pat. No. 3,112,505 discloses a device that combs out softened paint lumps with a rotary pin comb. Other patents utilize the cleaning of such objects as golf club heads, hair combs, eyeglasses and hair brushes (see U.S. Pat. Nos. 3,872,534, 2,082,991, 3,464,080 and 3,590,413, respectively). None of such devices provide means useful in removing paint from paint brush heels.

The U.S. Pat. No. 4,403,364 describes a complicated brush cleaning apparatus for spraying a hot soap solution of hot water onto the bristles of the brush while agitating it mechanically. Besides the complexity of this apparatus, its practical utility is limited due to the fact that water sprays are usually ineffective in cleaning the heel of the brush as they are not capable of penetrating inside the closely held bristles of the brush. A similar approach is described in the U.S. Pat. No. 4,912,797.

The U.S. Pat. No. 4,823,424 shows a paint brush cleaning funnel containing a liquid inlet portion and a flared out hollow funnel portion for placing of the paint brush therein. The liquid end portion is connected to a source of pressurized water or another cleaning solution while the brush is placed in the funnel. The limitation of this invention is in the fact that it may force brush bristles to get even more closely together thus preventing the cleaning solution from reaching the heel of the brush.

Finally, the U.S. Pat. No. 4,018,240 describes a device equipped with a plurality of tubular nozzles with closed ends and side holes located at the distal portions thereof. The nozzles are adapted to be placed inside the bristles at the level of the heel of the brush. A manual pump is provided to supply a cleaning solution to the area of the heel to wash the paint out. This patent is incorporated herewith in its entirety as the closest prior art to the present invention. The limitation of the invention described in this patent is in an uncontrolled discharge of cleaning solution while cleaning the brush. Besides, the shape of the nozzles precludes active separation of the bristles and may lead up to uneven cleaning if some bristles clump together and are pushed to the side by the disclosed apparatus.

In a related area of prior art, several methods have been devised to remove paint from paint rollers using the flow of water from a pressurized source. One method is to remove the paint soaked roller from its handle and install this roller on a hand held mechanical device. The roller is then submerged under water, and the mechanical device is pumped continually by hand to impart a slow rotary motion to the roller. The rotary motion and turbulence of the water removes most of the paint. A final rinse under running water is performed in an effort to remove the remaining paint residue. Another method include placing of a roller into a holder and pumping water through the center of the roller to rinse out the residual paint. Examples of such general approach can be found in the U.S. Pat. Nos. 2,985,178 and 4,641,673. Both methods are time consuming and require the continual presence and physical effort of the person performing the cleaning operation. Also, both methods require direct handling of the roller which is saturated with wet paint, resulting in a very messy task.

With any disclosed method of the prior art, unless the cleaning process is continued for an inordinate length of time, there will almost always be a residue of paint left within the brush or a roller. Although this will not represent a problem if the same shade of paint is used again with the same brush, this residual paint of one hue will often prevent the use of the semi-cleaned roller with paints of different hues. For these reasons, it is often the case that a paint brush will be thrown away after a single use rather than cleaned, a wasteful practice which further highlights a need for an effective paint brush cleaning apparatus.

Therefore, there remains a need for a paint brush cleaning device which can easily and rapidly remove paint from the bristles of paint brushes of various types and sizes, along the entire length of the bristles, including the heel portion of the brush. Such device should be simple, durable and efficient and be capable of being manufactured in a variety of forms to suit individual needs including home use.

SUMMARY OF THE INVENTION

Accordingly, it is an object of the present invention to overcome these and other drawbacks of the prior art by providing a novel device for cleaning paint brushes of various types and sizes using a pressurized source of cleaning solution and equipped with at least one nozzle for on-demand delivery of that solution between the bristles of a brush. The aim of the device is to allow multiple reuse of the paint brushes with different colors of paint.

It is another object of the present invention to provide a nozzle for a brush cleaning device adapted to control the discharge of the cleaning solution by having a poppet valve.

It is a further object of the present invention to provide a nozzle for a brush cleaning device, such nozzle being shaped to separate the bristles of the brush in a way most advantageous for subsequent cleaning by an outflow of the cleaning solution from the tip thereof.

It is yet a further object of the present invention to provide a cleaning device adapted to be connected to a pressurized source of cleaning solution. A related object of the invention is to provide a device for cleaning a paint brush adapted to be connected to a tap water source.

It is yet another object of the invention to provide a device for cleaning of paint brushes or paint rollers utilizing the minimum amount of cleaning solution for the most effective removal of wet paint.

It is yet another object of the invention to provide a simple to use cleaning device for paint brushes adapted to use at home for small house repair projects.

The device of the invention comprises a handle equipped with at least one nozzle and means for attachment for a source of cleaning solution. In the most basic form, the device of the invention has a threaded connection for attachment to a source of tap water under pressure. The handle of the device is adapted to either be fixed in place (such as in a stand) for manual or automatic placement of the brush under the nozzle thereof or alternately the handle is shaped to be held by hand for easy manipulations while cleaning the brush.

The nozzle of the device stems out from the handle and has a tapered shape to facilitate the separating of the brush bristles. Other shapes are also conceived of and include ribs and other protrusions designed to further open up and shuffle the bristles of the brush while it is being cleaned.

To provide an "on-demand" control of the flow of the cleaning solution, the distal tip of the nozzle is equipped with a shut-off valve. Preferably, the shut-off valve is a one-way check valve. In the most preferred configuration, the shut-off valve is a poppet valve to be activated by a direct contact of the nozzle tip with the paint clumps or the bristle divider at the heel of the brush. The presence of the shut-off valve insures the conservation of the cleaning solution, as its flow is cut-off when not needed.

BRIEF DESCRIPTION OF THE DRAWINGS

A more complete appreciation of the subject matter of the present invention and the various advantages thereof can be realized by reference to the following detailed description in which reference is made to the accompanying drawings in which.

DETAILED DESCRIPTION OF THE PREFERRED EMBODIMENT OF THE INVENTION

A detailed description of the present invention follows with reference to accompanying drawings in which like elements are indicated by like reference letters and numerals.

Figure 1:
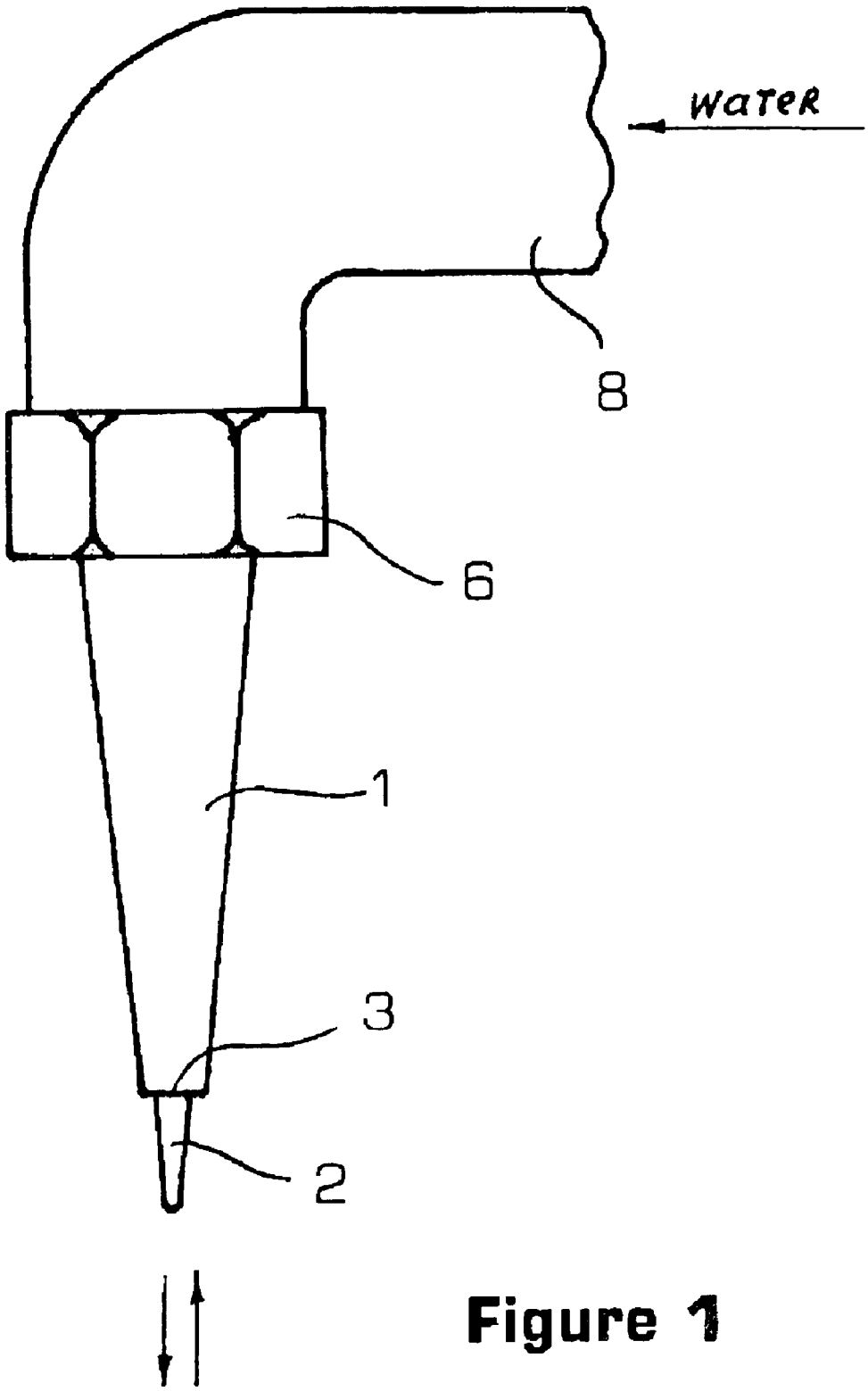
FIG. 1 is a general view of the device of the present invention.

The most basic configuration of the cleaning device of the present invention is shown on FIG. 1 as an attachment to a common tap water valve 8. It consists of a hollow nozzle 1 equipped with a shut-off valve 2 located at the lower distal section of the nozzle and closing off the opening of the distal discharge tip 3. The shape of the nozzle 1 is shown as a taper with narrowing directed towards the distal tip to facilitate separation of the bristles. Optionally (not shown on the drawings) it can be supplied with ribs of various shapes and directions as well as with other bumps and protrusions to further assist in bristle separation. The upper or proximal section 4 of the nozzle 1 is equipped with a lip 5. A nut 6 is adapted to attach the nozzle 1 to the water valve 8 by holding the lip 5 against the rubber gasket 7 seated against the threaded opening of the water valve 8. It can also be connected by the same means to a water hose with the same threaded connection. The length of the nozzle is adapted to reach the heel of the brush with the longest length bristles, preferably between 0.5 inches and 7 inches, and most preferably between 1 and 4 inches.

Figure 2:
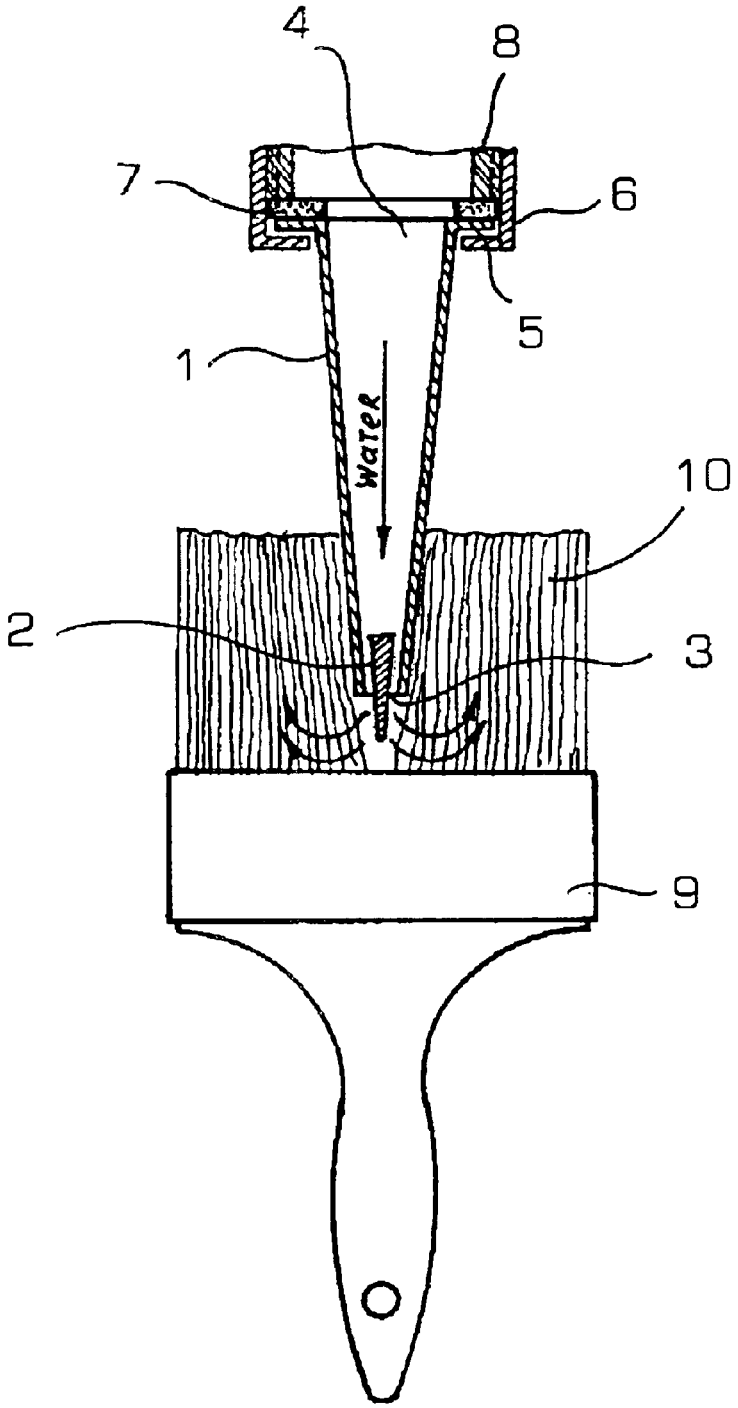
FIG. 2 is a general view of the device in use with the paint brush.

The lower section of the nozzle is equipped with a shut-off valve 2. In its most simple configuration shown on FIG. 2 the shut-off valve 2 is a poppet valve with a tapered body protruding from and shaped to close-off the small opening of the distal tip 3. The poppet valve body can freely move inwards and outwards of the distal tip therefore allowing to open and close the opening of the distal tip 3. Since this most basic configuration assumes a vertical orientation of the device (such as when assembled over a sink), there is no need to hold the poppet valve body in position as it will automatically fall in place due to gravity. When closed, the poppet valve will remain in this position under water pressure until it is moved upwards to open the flow of water. It should be understood that to use the device as a hand-held unit or in other non-vertical configurations, the poppet valve body may be supported by a spring (not shown) biased to hold the poppet body in a closed position.

In use, the nozzle is assembled onto a water valve and the valve is switched to the open position. The water pressure and gravity hold the poppet valve in a closed position. The paint brush 9 with bristles 10 covered with wet paint is positioned under the nozzle 1 so that the distal tip is separating the bristles apart and reaches the wet paint clumps or the heel of the brush, as shown in detail on FIG. 2. The brush 9 is then pushed up in the direction of the nozzle 1, so as to move up the poppet valve body 2 and open the flow of water into the center of the brush. Rushing water is directed from the center outwards and washes the paint away. As the nozzle reaches the heel of the brush, the water flow under pressure is reflected therefrom and directed upwards further removing the remaining paint from the bristles 10.

The brush 9 is then moved along the heel of the brush, upwards and downwards so that all paint is efficiently removed from all areas of the heel and bristles 10. The tapered shape of the nozzle is instrumental in separating the bristles 10 and further promoting penetration of the distal tip 3 into the center of the brush 9.

Upon complete removal of all paint, the brush 9 is moved down to release the poppet valve 2 and allow it to automatically close off the water flow. The design of the cleaning device of the present invention allows to conserve water as the water flow is turned on and off only during the actual use of the device.

This embodiment provides the most economical and simple to use way to clean the paint from brushes, rollers and alike. It can be used advantageously both on large construction projects as well as for small home repair type of paint projects.

ADDITIONAL EMBODIMENTS OF THE PRESENT INVENTION

Although not shown on the drawings, a number of additional embodiments are also contemplated. In one embodiment, two or more nozzles are used in parallel, each equipped with its own shut-off valve.

In another embodiment, the nozzle is attached to a hollow handle to facilitate manual or hand-held operation of the device. In this case, the handle shaped to be held in hand and is equipped with a flow connector to provide for pressurized source of cleaning solution. More than one nozzle can be used in this embodiment al well for a more rapid cleaning of a paint brush or a paint roller.

In a further embodiment, the handle of the device is adapted to be fixed in place by attaching thereof to a stand or clamping it over a sink or another means to drain away the cleaning solution.

Although the invention herein has been described with respect to particular embodiments, it is understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A cleaning device for a paintbrush comprising:

a hollow handheld unit, including a handle having a fluid connecting means for attaching for attaching to a source of pressurized cleaning solution; and at least one nozzle attached to and in fluid communication with said handle, said nozzle having a distal tip equipped with a self activating fluid biased shut-off valve containing an opening means to discharge a stream of said cleaning solution upon pressing of said brush against said opening means, said opening means protruding beyond said distal tip.

2. The cleaning device as in claim 1, wherein said nozzle having a tapered shape with narrowing towards said distal tip.

3. The cleaning device as in claim 2, wherein said opening means having a tapered shape matching that of said distal tip.

4. The cleaning device as in claim 1, wherein said nozzle is equipped with ribs to facilitate bristle separation of said paint brush.

5. The cleaning device as in claim 1, wherein said shut-off valve is a check valve.

6. The cleaning device as in claim 5, wherein said check valve is a poppet valve.

7. The cleaning device as in claim 6, wherein said poppet valve is spring-biased.

8. The cleaning device as in claim 6, wherein said poppet valve is a needle valve, said opening means being a needle of said needle valve.

9. A hollow nozzle for cleaning a paint brush, said nozzle comprising a proximal section and a distal section, said proximal section of said nozzle is removabley connectable to a source of pressurized cleaning solution, said distal section having a distal tip equipped with a self-activating fluid-biased shut-off valve containing an opening means to discharge a stream of said cleaning solution upon pressing of brush against said opening means, said opening means protruding beyond said distal tip.

10. The nozzle as in claim 9, wherein said nozzle having a tapered shape with narrowing towards said distal tip.

11. The nozzle as in claim 10, wherein said opening means having a tapered shape matching that of said distal tip.

12. The nozzle as in claim 9, wherein said nozzle is equipped with ribs to facilitate bristle separation of said paint brush.

13. The cleaning device as in claim 9, wherein said shut-off valve is a check valve.

14. The cleaning device as in claim 13, wherein said valve is a poppet valve.

15. The cleaning device as in claim 14, wherein said poppet valve is spring-biased.

16. The cleaning device as in claim 14, wherein said poppet valve is a needle valve, said opening means being a needle of said needle valve.

* * * * *